US007719190B2

(12) United States Patent
Jang

(10) Patent No.: US 7,719,190 B2
(45) Date of Patent: May 18, 2010

(54) PLASMA DISPLAY PANEL

(75) Inventor: Soon-Ho Jang, Suwon-si (KR)

(73) Assignee: Samsung SDI Co., Ltd. (KR)

( * ) Notice: Subject to any disclaimer, the term of this patent is extended or adjusted under 35 U.S.C. 154(b) by 484 days.

(21) Appl. No.: 11/784,396

(22) Filed: Apr. 5, 2007

(65) Prior Publication Data

US 2007/0241684 A1 Oct. 18, 2007

(30) Foreign Application Priority Data

Apr. 14, 2006 (KR) ..... 10-2006-0034174

(51) Int. Cl.
*H01J 17/49* (2006.01)

(52) U.S. Cl. ..... 313/582; 313/584

(58) Field of Classification Search ..... 313/582–584
See application file for complete search history.

(56) References Cited

FOREIGN PATENT DOCUMENTS

KR 1020040063329 A 7/2004

*Primary Examiner*—Vip Patel
(74) *Attorney, Agent, or Firm*—Knobbe Martens Olson & Bear LLP

(57) ABSTRACT

There is provided a PDP that can both prevent cross-talk between discharge cells and improve contrast, comprising a first substrate and a second substrate bonded to face each other; a plurality of discharge cells formed between the first substrate and the second substrate; a plurality of X electrodes formed between the first substrate and the second substrate and crossing the discharge cells; and a plurality of Y electrodes formed between the first substrate and the second substrate and crossing the discharge cells, wherein the discharge cells in the direction perpendicular to the direction in which the X electrodes and the Y electrodes extend share the X electrodes with the adjacent discharge cells.

7 Claims, 2 Drawing Sheets

PLASMA DISPLAY PANEL

CROSS-REFERENCE TO RELATED PATENT APPLICATION

This application claims the benefit of Korean Patent Application No. 10-2006-0034174, filed on Apr. 14, 2006, in the Korean Intellectual Property Office, the disclosure of which is incorporated herein in its entirety by reference.

BACKGROUND OF THE INVENTION

1. Field of the Invention

The present embodiments relate to a plasma display panel (PDP), and more particularly, to a plasma display panel that can both improve contrast and prevent cross-talk between discharge cells.

2. Description of the Related Art

Plasma Display Panels (PDPs), which display images using a gas discharge, are known for their excellent display capabilities such as brightness, contrast, residual image, viewing angle, etc., and have drawn attention as display devices that can replace cathode ray tubes. PDPs emit light by exciting phosphor using an emission of ultraviolet rays occurring with a discharge between electrodes which is generated by a direct current voltage (DC voltage) or an alternating current voltage (AC Voltage) applied to the electrodes.

A PDP includes a first substrate and a second substrate which face each other to form a discharge space, a plurality of pairs of discharge sustain electrodes that are disposed on the first substrate, a plurality of address electrodes that are disposed on the second substrate, and barrier ribs that define the discharge space into a plurality of discharge cells.

The discharge sustain electrodes are disposed in pairs of an X electrode and a Y electrode, so that X electrodes and Y electrodes are disposed in an X-Y-X-Y . . . order. Therefore, an X electrode and a Y electrode are adjacent between adjacent discharge cells, thus generating cross-talk.

Referring to FIG. 1 for a more detailed description, the X electrodes and the Y electrodes are sequentially disposed in a $Y_1$, $X_1$, $Y_2$, $X_2$. . . order in the vertical direction of the paper, each X and Y electrode extending in the horizontal direction of the paper, and the address electrodes are disposed to intersect the X and Y electrodes at right angles in an $A_1$, $A_2$, . . . order. A first discharge cell (C1) is formed where A1 crosses $X_1$ and $Y_1$, and a second discharge cell (C2) is formed where $A_1$ crosses $X_2$ and $Y_2$.

Here, the $X_1$ electrode and the $Y_2$ electrode are adjacent, thereby allowing cross-talk.

In PDPs, black stripes are formed of a black insulator between each pair of discharge sustain electrodes, that is, between each pair of X and Y electrodes, to improve contrast. A typical example of the black stripes is disclosed in U.S. Pat. No. 5,661,500.

However, this remains problematic in that a separate space is needed for disposing black stripes to improve contrast, which diminishes the discharge cell area and increases the number of the manufacturing steps.

Thus, the present embodiments, contrived to solve problems including those mentioned above, are intended to provide a plasma display panel that can improve contrast and prevent cross-talk between discharge cells.

SUMMARY OF THE INVENTION

The present embodiments provide a plasma display panel (PDP) including a first substrate and a second substrate bonded to face each other; a plurality of discharge cells disposed between the first and second substrates; a plurality of X electrodes crossing the discharge cells and formed between the first and second substrates; and a plurality of Y electrodes crossing the discharge cells and formed between the first and second substrates, wherein the X electrodes are shared by the discharge cells in the direction perpendicular to the direction in which the X and Y electrodes extend.

The present embodiments also provide a PDP including a first substrate and a second substrate bonded to face each other; a plurality of X electrodes formed on the surface of the first substrate facing the second substrate, apart a predetermined distance from each other; and a plurality of Y electrodes formed on the surface of the second substrate facing the first substrate, disposed in pairs between the X electrodes.

According to an aspect of the present embodiments, there is provided a PDP including a first substrate and a second substrate bonded to face each other; a plurality of discharge cells disposed between the first and second substrates; a plurality of X electrodes crossing the discharge cells and formed between the first and second substrates; and a plurality of Y electrodes crossing the discharge cells and formed between the first and second substrates, wherein the X electrodes are shared by the discharge cells in the direction perpendicular to the direction in which the X and Y electrodes extend.

The width of the X electrodes may be wider than the width of the Y electrodes.

The Y electrodes may be adjacent between the discharge cells in the direction perpendicular to the direction in which the X electrodes and the Y electrodes extend.

An external light absorbing layer may further be included between the Y electrodes.

The X electrodes and Y electrodes include transparent electrodes and bus electrodes, respectively and the shared X electrodes may be bus electrodes. The bus electrodes may be formed of a material that absorbs external light.

According to another aspect of the present embodiments, there is provided a PDP including a first substrate and a second substrate bonded to face each other; a plurality of X electrodes formed on the surface of the first substrate facing the second substrate, apart a predetermined distance from each other; and a plurality of Y electrodes formed on the surface of the second substrate facing the first substrate, disposed in pairs between the X electrodes.

The width of the X electrodes may be wider than the width of the Y electrodes.

An external light absorbing layer may further be included between a pair of the Y electrodes disposed between the X electrodes.

The X electrodes and Y electrodes include transparent electrodes and bus electrodes, respectively, and a pair of bus electrodes of Y electrodes may be disposed between the bus electrodes of X electrodes.

The width of the bus electrodes of the X electrodes may be wider than the width of the bus electrodes of the Y electrodes.

The bus electrodes may be formed of a material that absorbs external light.

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION OF THE INVENTION

Hereinafter, the present embodiments will be described in detail by explaining exemplary embodiments with reference to attached drawings.

Figure 1:
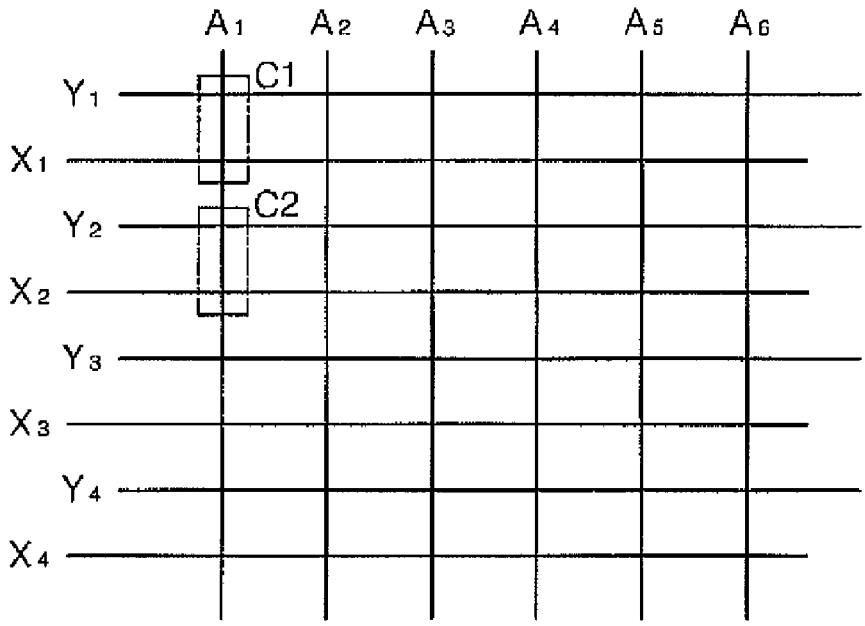
FIG. 1 is a simplified plan view showing a layout of electrodes of a conventional plasma display panel (PDP)
Figure 2:
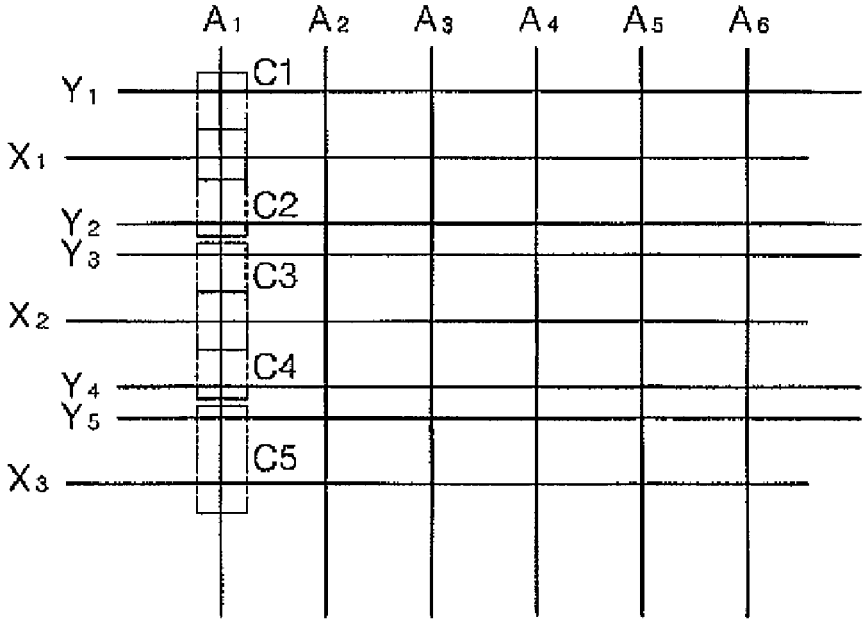
FIG. 2 is a simplified plan view showing an electrode layout of a PDP according to an embodiment.

FIG. 2 is a simplified plan view showing a disposition of electrodes of a plasma display panel (PDP) according to an embodiment.

Referring to FIG. 2, in a PDP according to an embodiment, address electrodes which extend in the vertical direction of the paper are disposed so as to be spaced a predetermined distance apart from each other in an $A_1, A_2, A_3, \ldots$ order.

X electrodes and Y electrodes are disposed to intersect the address electrodes at right angles. First, the X electrodes that extend in the horizontal direction of the paper are disposed parallel to each other and spaced a predetermined distance apart from each other in an $X_1, X_2, X_3, \ldots$, order. A pair of Y electrodes are disposed between and parallel to the X electrodes. However, the $Y_1$ Y electrode is disposed singularly outside of the X electrodes when starting from a Y electrode according to an embodiment illustrated in FIG. 2. A discharge cell is formed where the address electrodes cross X electrodes and Y electrodes.

According to an embodiment, a first discharge cell (C1) is formed where the A1 address electrode crosses the $Y_1$ Y electrode and the $X_1$ X electrode, and a second discharge cell (C2) is formed where the A1 address electrode crosses the $Y_2$ Y electrode and the $X_1$ X electrode. Also, a third discharge cell (C3) is formed where the $A_1$ address electrode crosses the $Y_3$ Y electrode and the $X_2$ X electrode, a fourth discharge cell (C4) is formed where the A1 address electrode crosses the $Y_4$ Y electrode and the $X_2$ X electrode, and a fifth discharge cell (C5) is formed where the A1 address electrode crosses the $Y_5$ Y electrode and the $X_3$ X electrode. In FIG. 2, only 5 discharge cells in the vertical direction of the paper are shown as examples, and other discharge cells are omitted. Regarding the embodiment shown in FIG. 2, it is apparent that the discharge cells in the first row are not disposed in the form of a pair of Y electrodes between X electrodes.

Likewise, according to a preferred embodiment, contiguous discharge cells disposed in the vertical direction of address electrodes ($A_1, A_2, A_3, \ldots$) share an X electrode. An example in which a Y electrode is disposed first is shown in FIG. 2. however an X electrode can be disposed first. In this case, it is apparent that the X electrode in the first row cannot be shared.

In such a structure as above, X electrodes become Common electrodes, and Y electrodes become Scan electrodes. Since a common voltage is applied to the X electrodes, driving pixels are not affected by the fact that the X electrodes are shared by contiguous discharge cells. According to a preferred embodiment, as shown in FIG. 2, X and Y electrodes are not adjacent to each other, but rather electrodes of same kind are adjacent between adjacent discharge cells, and thus there is no possibility that cross-talk is generated between contiguous discharge cells.

Figure 3:
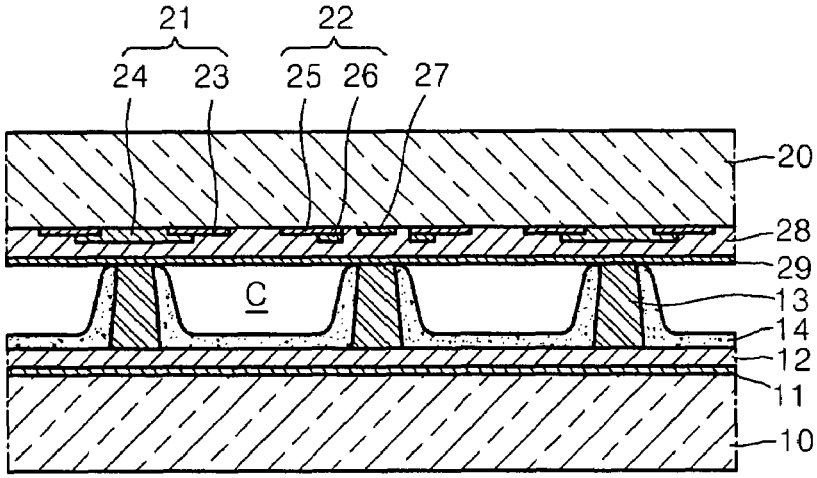
FIG. 3 is a cross sectional view of a PDP according to an embodiment.
Figure 4:
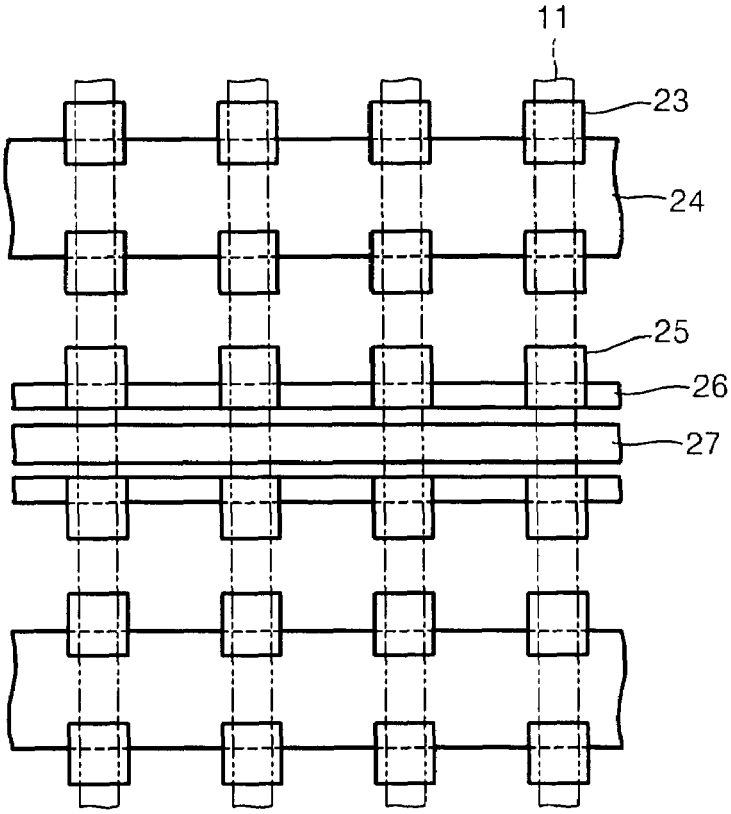
FIG. 4 is a plan view showing electrodes of a PDP according to an embodiment.

FIG. 3 is a sectional view showing a structure of a PDP according to a preferred embodiment, wherein the electrode structure shown in FIG. 2 is embodied. FIG. 4 is a plan view showing the electrode structure of the same.

Referring to FIG. 3, in a PDP according to a preferred embodiment, a first substrate 10 and a second substrate 20 are disposed to face each other, a discharge gas such as Ne, Xe, and the like is filled between the first and second substrates 10, 20 which form a discharge space, and edges of the substrates are bonded together and sealed by a sealing member such as a frit glass (not shown).

Barrier ribs 13 are formed between the first substrate 10 and the second substrate 20 and define the space between the first and second substrates 10, 20 into a plurality of discharge cells (C).

The barrier ribs can be formed of a dielectric commonly used in typical PDPs, using various methods such as screen printing, sand blasting, a dry film method, photolithography, etc. The barrier ribs 13 can be formed in a lattice shape, but are not limited thereto, and can be formed in various shapes such as a honeycomb, a circle, etc.

Around a discharge cell (C) defined by the barrier ribs 13, discharge sustain electrodes such as X electrodes 21 and Y electrodes 22, and address electrodes 11 are formed so as to cross each other to generate a discharge. According to a preferred embodiment, the address electrodes 11 are disposed on the first substrate, and the X and Y electrodes 21, 22, that is, the discharge sustain electrodes, are formed on the second substrate 20 to intersect the address electrodes 11 and to be parallel to each other. One unit of the discharge cell (C) is formed where the X and Y electrodes 21, 22 and the address electrode 11 intersect each other, as shown in FIG. 2 above.

The address electrodes 11 can be formed to be not exposed to the discharge cells. According to a preferred embodiment, a first dielectric layer 12 can be formed to cover the address electrode 11 on the first substrate 10. The first dielectric layer 12 may be formed to exhibit white color to improve brightness of the entire panel. The address electrode 11 can be formed in a stripe pattern parallel to one side of the first substrate 10.

Pairs of discharge sustain electrodes 21, 22 are formed as a pair of an X electrode 21 and a Y electrode 22. The X electrode 21 and Y electrode 22 extend in a direction substantially perpendicular to the direction in which the address electrode 11 extends.

The X electrode 21 and the Y electrode 22 can be formed of transparent electrodes 23 and 25, respectively, which may be formed of Indium Tin Oxide (ITO) which is a transparent conductor, and bus electrodes 24 and 26, respectively, which may be formed of highly conductive Ag, Au, or Cu, and are connected to the transparent electrodes 23 and 25 respectively. According to a preferred embodiment, the transparent electrodes 23, 25 are formed in an island shape in each discharge cell, and the bus electrodes 24, 26 can be formed in a stripe shape substantially perpendicular to the address electrode 11. A black additive material can be contained in the bus electrodes 24, 26 to improve contrast. Black additive materials are not necessarily black, but materials having low reflectivity which can absorb external light may be used.

In a preferred embodiment, as shown in FIG. 4, the bus electrode 24 of the X electrodes are formed to be wider than the bus electrode 26 of the Y electrodes so that the bus electrode 24 of X electrodes can be shared by the contiguous discharge cells. Therefore, as shown in FIGS. 3 and 4, the bus electrode 24 of X electrodes covers edges of the transparent electrodes 23, each of the transparent electrodes extending to two discharge cells. Forming the bus electrodes 24 of X electrodes widely so that they can be shared by two adjacent discharge cells increases external light absorption, thereby further improving contrast.

An external light absorbing member 27 in the form of a black stripe is further formed between the bus electrodes 26 of the Y electrodes to improve contrast. The external light absorbing member 27 can be manufactured using the same material as used in the bus electrodes 24, 26 at the same time, thus allowing a process for forming the external absorbing member 27 to be omitted and reducing material costs and manufacturing time. However, the material for the external light absorbing member is not limited thereto, and can be a black insulator.

A second dielectric layer 28 is formed on the second substrate 20 to cover the X electrodes 21 and the Y electrodes 22, and a protecting layer 29, including MgO, for example, which can also function substantially as a cathode, can be formed on the second dielectric layer.

A phosphor layer 14 can be formed on at least one side of the discharge cell (C). According to a preferred embodiment, the phosphor layer may be formed on the first dielectric layer 12 of the first substrate 10 and the side wall of the barrier ribs 13. The phosphor layer 14 can be formed as a red (R), green (G), or blue (B) layer according to each discharge cell defined by the barrier ribs 13.

According to the present embodiments, cross-talk is prevented by avoiding adjoining of an X electrode with a Y electrode between adjacent discharge cells, through sharing an X electrode between adjacent discharge cells. In addition, by forming X electrodes more widely than Y electrodes, contrast can be improved and the process can be simplified.

While the present embodiments have been particularly shown and described with reference to exemplary embodiments thereof, it will be understood by those of ordinary skill in the art that various changes in form and details may be made therein without departing from the spirit and scope of the present embodiments as defined by the following claims.

What is claimed is:

1. A plasma display panel (PDP) comprising:

a first substrate and a second substrate bonded to face each other;

a plurality of discharge cells disposed between the first substrate and the second substrate;

a plurality of X electrodes crossing the discharge cells and disposed between the first substrate and the second substrate; and a plurality of Y electrodes crossing the discharge cells and disposed between the first substrate and the second substrate, wherein at least one set of two adjacent discharge cells disposed next to each other in a direction substantially perpendicular to the direction in which the X electrodes and the Y electrodes extend share a common X electrodes.

2. The PDP of claim 1, wherein the width of bus electrode of the X electrodes is larger than the width of the bus electrode of the Y electrodes.

3. The PDP of claim 1 further comprising external light absorbing layers between the Y electrodes.

4. The PDP of claim 1, wherein the X electrodes and the Y electrodes comprise transparent electrodes and bus electrodes, and wherein the shared X electrodes are bus electrodes.

5. The PDP of claim of claim 4, wherein the bus electrodes are comprised of a material that absorbs external light.

6. The PDP of claim 1, further comprising a protective layer.

7. The PDP of claim 6, wherein the protective layer comprises MgO.

* * * * *